United States Patent [19]

Kostylev et al.

[11] 4,440,240

[45] Apr. 3, 1984

[54] METHOD OF MAKING HOLES IN THE SOIL AND APPARATUS FOR PERFORMING THIS METHOD

[75] Inventors: Alexandr D. Kostylev; Vladimir P. Gileta; Vladimir A. Grigoraschenko; Khaim B. Tkach, all of Novosibirsk; Vladimir A. Bakunin, Odessa; Valery Y. Frenkel, Moscow; Valery A. Kozlov, Novosibirsk; Jury B. Reifisov, Novosibirsk; Nikolai P. Chepurnoi, Novosibirsk; Mikhail J. Bondar, Odessa; Vladimir F. Drobyazko, Odessa; Stanislav B. Stazhevsky, Novosibirsk; Gerald I. Ratskevich, Novosibirsk; Alexandr A. Fedorov, Novosibirsk; Anatoly S. Polyakov, Moscow; Leonid M. Bobylev, Moscow; Evgeny N. Tsvetkov, Odessa; Anatoly M. Petreev, Novosibirsk, all of U.S.S.R.

[73] Assignee: Institut Gornogo Dela Sibirskogo Otdelenia Akademii Nauk SSSR, Novosibirsk, U.S.S.R.

[21] Appl. No.: 264,684

[22] Filed: May 18, 1981

[30] Foreign Application Priority Data

Jan. 4, 1979 [SU] U.S.S.R. ..... 2706741

[51] Int. Cl.[3] ..... E21B 7/26; E21B 11/02

[52] U.S. Cl. ..... 175/20; 15/104.07; 175/62; 175/253

[58] Field of Search ..... 175/19, 20, 62, 249–255, 175/312; 15/104.07, 104.06 R

[56] References Cited

U.S. PATENT DOCUMENTS

| | | | |
|---|---|---|---|
| 742,644 | 10/1903 | Hart | 15/104.06 R |
| 876,566 | 1/1908 | Lehnert | 15/104.06 R |
| 1,339,098 | 5/1920 | Burlingham | 15/104.07 |
| 1,696,677 | 12/1928 | Hayton | 15/104.06 R |
| 1,766,108 | 6/1930 | Copelin | 175/249 X |
| 1,896,469 | 2/1933 | Soll | 175/249 X |
| 1,972,402 | 9/1934 | Jones | 15/104.07 X |
| 3,023,810 | 3/1962 | Anderson | 175/312 X |
| 3,283,833 | 11/1966 | Bodine, Jr. | 175/62 |
| 3,507,342 | 4/1970 | Hasewend et al. | 175/62 |
| 3,540,537 | 11/1970 | Brown | 175/255 X |
| 3,674,099 | 7/1972 | Kostylev et al. | 175/20 |
| 3,805,900 | 4/1974 | Sainsbury | 175/20 |
| 3,955,631 | 5/1976 | Kostylev et al. | 175/20 |
| 4,059,155 | 11/1977 | Greer | 175/254 X |
| 4,124,082 | 11/1978 | Garver | 175/20 X |
| 4,132,277 | 1/1979 | Tupitsyn et al. | 175/19 |

FOREIGN PATENT DOCUMENTS

| | | | |
|---|---|---|---|
| 46190 | 12/1919 | Sweden | 15/104.07 |
| 554397 | 4/1977 | U.S.S.R. | 175/249 |

*Primary Examiner*—George A. Suchfield
*Attorney, Agent, or Firm*—Lilling & Greenspan

[57] ABSTRACT

The method of making holes in the soil includes driving a capsule into the soil by percussive action and filling the capsule with the soil. Then the driving of the capsule into the soil by percussive action is continued, with the soil passing therethrough. The capsule is then withdrawn from the hole, and the soil that has passed through the capsule is also removed from the hole, whereafter the soil is removed from the capsule itself. The apparatus for making holes, performing the disclosed method, comprises a capsule capable of receiving the soil therein, having an open soil intake end, its opposite end being a partly open one. The capsule incorporates a percussive mechanism.

32 Claims, 26 Drawing Figures

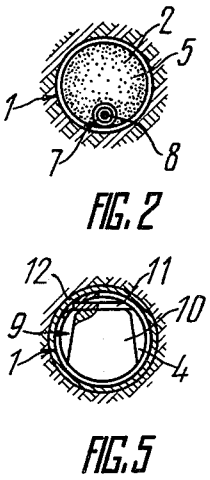
FIG. 2
FIG. 5
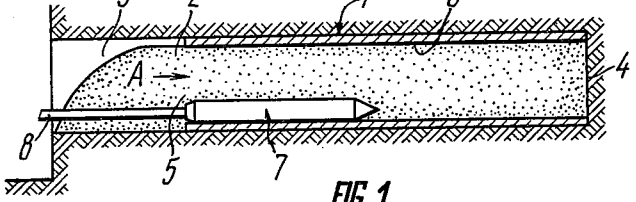
FIG. 1
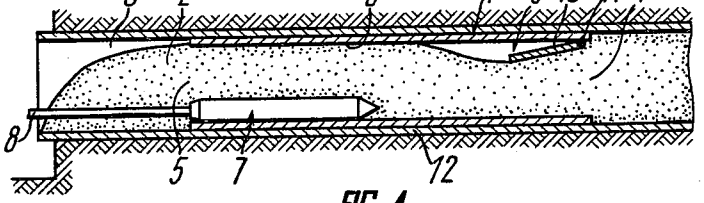
FIG. 4
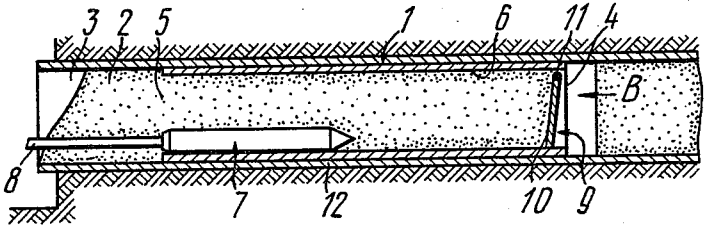
FIG. 3

METHOD OF MAKING HOLES IN THE SOIL AND APPARATUS FOR PERFORMING THIS METHOD

FIELD OF THE INVENTION

The invention relates to methods and apparatus for conducting work in the soil, and more particularly it relates to methods of making holes in the soil and to apparatus capable of performing such methods.

The invention can be utilized in civil engineering for making holes under engineering structures, e.g. for laying underground communication lines under highways and railways, for cleaning soil from pipes driven into earth with their open end leading with the aid of various jacks or other suitable means, to serve as protective casings; for preparing vertical and inclined holes for piles to be used in the foundations of engineering structures, and for other similar purposes.

In land reclamation, the invention can be utilized for making water level lowering holes and wells.

In geologic surveys, the invention can be employed for sampling the soil at various depths, as well as for making survey wells.

DESCRIPTION OF THE PRIOR ART

There is known a method of making holes in the soil, including the following operations: driving a pipe with its open end leading into the soil, by applying to it a static pressing effort with either a jack or a winch, through a tackle system, breaking up the soil filling the pipe either by means of a power-operated working member or manually, and conveying the thus broken-up soil from the pipe being driven into the soil with augers, conveyers, small cars and other vehicles (cf. "Machines for Constructing Major Pipelines" by V. I. Minayev, in Russian, NEDRA Publishers, Moscow, 1973).

However, the use of jacks and winches for pressing pipes into the soil requires that the working site should be provided with a specific thrust wall, to take up the reaction effort of the means operated for pressing the pipe into the soil, and thus to avoid damage to the pit being prepared at the working site.

Mechanical breaking-up of the soil and its removal from a pipe being driven into the soil can be performed by an independent device incorporating a drive for transmitting motion to the working member and another drive for conveying the soil from the working face.

This technique, however, involves the use of bulky, complicated multi-drive equipment which significantly complicates the work.

Manual breaking up of the soil in a pipe and removing it is practical with pipes having a diameter not less than 800 mm, to say nothing of the poor sanitary conditions of such work.

There is further known a method of making holes in the soil, including the operations of advancing a soil-intake device (to be hereinafter referred to as "the capsule") in the hole, filling the capsule with the soil and withdrawing the capsule with the soil filling it from the hole (cf. "Vibro-Vacuum Excavation of Soil" by G. E. Paraubek, in Russian, Works of Moscow Engineering Economy Institute, Edition 3, NAUKA Publishers, Moscow, 1954). The operations of moving the capsule to the bottom of the hole and back are effected with a winch and tackle system. The operation of driving the capsule into the soil is effected by applying an axial effort to the bottom of the capsule. The axial effort is created by providing suction within the capsule and thus providing a pressure drop across the bottom of the capsule, this effort being proportional to the value of the suction and the cross-sectional area of the capsule.

However, this technique requires complicated equipment of low throughput and limited field of applications. Driving holes by this technique is possible exclusively in binder soil, with the hole driving rate in a range from 0.3 to 0.6 meters per hour. This low throughput can be explained by the relatively small volume of the soil removed from the hole, amounting to 0.5 to 0.6 of the internal volume of the capsule.

There is further known an apparatus for making holes, performing the abovedescribed method and including a cylindrical capsule shaped as a sleeve with a closed end, its opposite end being open in the soil intake direction, and a vibrator mounted on the closed end of the capsule (cf. the abovecited "Machines for Constructing Major Pipelines" by V. I. Minayev).

The closed end of the capsule has a duct made therethrough, to connect the internal space of the capsule to a vacuum pump for evacuating this space. The capsule is operated with a set of rods connected through a tackle system to a winch, the rods having thrust shoes of the same external diameter as the capsule.

It should be noted, however, that this known apparatus is of a relatively small capacity, on account of the limited volume of the soil removed with the capsule, being dependent as this volume is on the internal volume of the capsule.

The field of applications of the apparatus is limited to use only in consolidated and binder soils as it is driven into the soil by the suction created internally of the capsule, which latter is to be sealingly pressed against the soil body, whereby it is obvious that the apparatus can be used only in consolidated and binder soils.

Furthermore, the operation of the apparatus is complicated on account ot its having three drives and requiring building up of the rod string following each run of the capsule into the hole; besides, with the working pit being of limited dimensions, which more often than not is the case under urban conditions, the rod string has to be dismantled every time the capsule with the soil is withdrawn from the hole.

There is still another known method of making holes in the soil by driving a capsule into the soil by percussive action, filling the capsule with the soil and subsequently withdrawing the capsule from the soil and removing the soil therefrom (cf. "Drilling Holes for Engineering and Geological Survey" by B. M. Rebrik, in Russian, NEDRA Publishers, Moscow, 1979, pp. 210–211). According to this method, the capsule is run into the hole and back either with a winch or by an earth-drilling unit connected to the capsule through a string of rods.

The method is characterized by a relatively low throughput, on account of the volume of the soil removed in one operating cycle being smaller than the internal volume of the capsule, or else, at the maximum, equal to this volume. Furthermore, the operation with a string of rods requires time for assembling and dismantling this string. Besides, the method is impractical for making inclined and horizontal holes.

The method also involves the use of additional equipment for running the capsule into the hole and back, which increases the amount of consumed labour and complicates the work.

There is also known an apparatus for making holes in the soil, performing the last-described method and comprising a soil-intake capsule having an end open in the soil intake direction, and a percussion mechanism (cf. the abovecited reference).

In this known apparatus the end of the capsule, opposite to the one open in the soil intake direction, is closed and has the percussion mechanism mounted thereon. Consequently, the apparatus is characterized by a relatively small throughput on account of the limited volume of the soil removed with the capsule, which volume is either smaller than the internal volume of the capsule, or, at the most, equal to this volume.

The external lateral surface of the capsule has an annular shoulder made thereon, of a diameter somewhat greater than the external diameter of the percussion mechanism housing. This apparatus has its field of applications limited to vertical holes. This can be explained by the fact that the apparatus is unstable at driving an inclined or horizontal hole, on account of the abovementioned annular shoulder on the external lateral surface of the capsule.

The use of additional equipment required for running the apparatus into the hole and back complicates the operation.

SUMMARY OF THE INVENTION

It is an object of the present invention to provide a method of making holes in the soil, which should enhance the productivity.

It is another object of the present invention to provide a simple and easily operable apparatus for making holes in the soil, capable of performing the said method.

It is a further object of the present invention to provide an apparatus for performing the said method, of significantly broadened production capabilities in the field of making holes in the soil, i.e. capable of making holes at any angle of inclination to a horizontal plane, and also of removing soil from pipes driven into the soil with the open end leading.

The objects are attained by providing a method of making holes in the soil by driving a capsule into the soil by percussive action, filling it with the soil and subsequently withdrawing the capsule from the soil and removing the soil therefrom. In accordance with the invention, following the filling of the capsule with the soil, the driving of the capsule into the soil by percussive action is continued, while passing the soil therethrough, and, when the capsule is being withdrawn from the hole, the soil that have passed through the capsule is additionally removed from the hole.

It is expedient that the withdrawal of the capsule with the soil from the hole and the removal of the soil that have passed through the capsule should be effected simultaneously by altering the direction and frequency of the percussive action.

The objects are also attained by providing an apparatus for making holes in the soil, capable of performing the above-said method, comprising a capsule adapted for receiving the soil therein and having an end face open in the soil intake direction, and a percussion mechanism. In accordance with the present invention, the end face of the capsule, opposite to the end face open in the soil intake direction, is at least partly open.

It is expedient that the percussion mechanism should be secured on the inner surface of the capsule, adjacent to its at least partly open end face.

It is desirable that the capsule should incorporate at least one element at least partly closing the end face open in the soil intake direction.

The securing of the percussion mechanism to the inner surface of the capsule can be accomplished with aid of a securing mechanism.

It is quite reasonable that the mechanism securing the percussion mechanism to the inner surface of the capsule should include a sleeve adapted to accommodate the head portion of the percussion mechanism therein, directly attached by a part of its external surface to the inner surface of the capsule, the axis of the sleeve extending parallel with the longitudinal axis of the capsule, and the projection of the sleeve onto a plane perpendicular to the longitudinal axis of the capsule being smaller than the projection of the inner contour of the capsule onto the same plane. The securing mechanism further includes a retaining member adapted to accommodate the tail portion of the percussion mechanism therein, directly attached by a part of its external surface to the inner surface of the capsule coaxially with the sleeve, its cross-sectional dimensions being commensurate with the cross-sectional dimensions of the sleeve.

The retaining mechanism can include a sleeve receiving the tail portion of the percussion mechanism therein, secured to the inner surface of the capsule and serving as one of the members of a screw-and-nut couple, or of a wedge couple.

It may be expedient that the mechanism securing the percussion mechanism to the inner surface of the capsule should include a sleeve adapted to receive the head portion of the percussion mechanism therein, arranged coaxially with the capsule and attached to the inner surface thereof ribs.

It is desirable that the element at least partly closing the end face open in the soil intake direction should include at least one gate mounted for pivoting in a direction opposite to the soil intake direction.

The element at least partly closing the end face open in the soil intake direction can be in the form of a set of blades of which the sharpened edges are facing in the soil intake direction, the blades being mounted to define openings or ports therebetween.

It may be reasonable that the element at least partly closing the end face open in the soil intake direction should include a sleeve of which the inner surface has made therein at least one annular groove accommodating therein either a ring with a serrated inner surface, or a spring, mounted for longitudinal displacement.

It may be expedient that the capsule should be made in the form of a trough adjacent to its open end face opposite to the end face open in the soil intake direction.

It may be also desirable that the capsule should be shaped as a trough adjacent to its end face open in the soil intake direction, this trough being arranged at the same side as the trough adjoining the opposite end face, the troughs being interconnected by a portion of the capsule shaped as a cylinder.

It is quite reasonable that the housing of the capsule should be made up of two longitudinally extending parts conjugated by their sides in the direction of the longitudinal axis of the capsule along a broken line of which the contour is defined by alternating projections and recesses made in the two parts, with the recesses of one part complementing the projections of the other part.

In applications concerned with cleaning a pipe from soil, one of the longitudinally extending parts of the housing of the capsule can be provided with a resilient member adapted to engage the pipe, having one of its ends secured to this longitudinally extending part.

It is expedient that one of the ends of the resilient member should include an element for adjusting the effort of urging the resilient member against the pipe.

The construction of the disclosed apparatus for making holes, capable of performing the method in accordance with the invention, provides for enhanced productivity. Furthermore, the apparatus is simple and easy in operation.

BRIEF DESCRIPTION OF THE DRAWINGS

The abovesaid and other objects of the present invention will become apparent from the following description of embodiments of the invention and from the accompanying drawings, wherein:

FIG. 1 is a longitudinal sectional view of an apparatus performing a method in accordance with the invention;

FIG. 2 is a view taken along arrow line A in FIG. 1;

FIG. 3 is a longitudinal sectional view of another version of an apparatus performing a method in accordance with the invention, as it is being withdrawn from the hole;

FIG. 4 is a longitudinal sectional view of the same apparatus shown in FIG. 3, as it is being driven into the soil;

FIG. 5 is a partly broken away view taken along line B in FIG. 3;

DETAILED DESCRIPTION OF THE INVENTION

Figure 6:
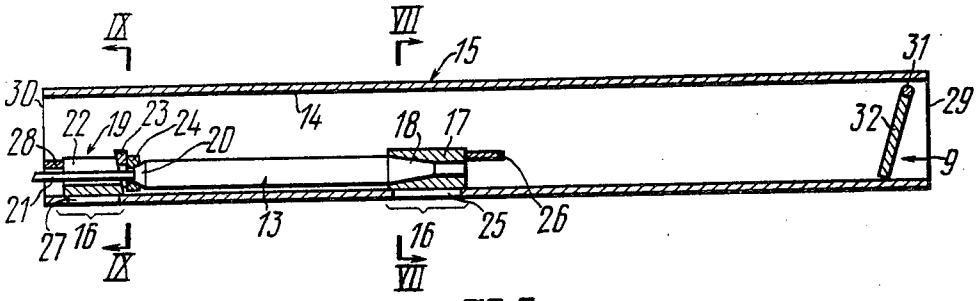
FIG. 6 is a longitudinal sectional view of still another version of an apparatus for for performing a method according to the invention.

A method of making holes in the soil, according to the invention, includes driving a capsule 1 (FIG. 1) into the soil 2 by percussive action applied axially of the capsule 1 in the soil intake direction, filling the capsule 1 with soil 2 and continuing the driving of the capsule 2 (already filled with the soil 2) further into the soil 2 by percussive action likewise applied axially of the capsule 1 in the soil intake direction, while passing the soil 2 through the capsule 1, as shown in FIG. 1. Then the capsule 1 is withdrawn from the hole 3 made in the soil 2, while simultaneously removing from the hole 3 the soil 2 that have passed through the capsule 1, whereafter the soil 2 is removed from the capsule 1 itself.

To perform this method, the apparatus embodying the invention comprises the abovesaid capsule 1 adapted to receive the soil 2 therein. The capsule 1 has an end face 4 open in the soil intake direction, and the end face 5 opposite to the aforementioned end face 4 is also open, as it can be seen in FIG. 2.

The end face 5, opposite to the open face 4 in the soil intake direction, can also be but partly open.

The inner surface 6 of the capsule 1 (FIG. 1) has a percussion mechanism 7 mounted thereon adjacent to the at least partly open end 5, having a hose 8 for supplying the energy carrier, e.g. compressed air thereto. In the embodiment being described the percussion mechanism 7 is welded to the inner surface 6 of the capsule 1.

Still, the percussion mechanism can be alternatively secured on the external surface of the capsule. However, such embodiments of the apparatus would effect partial destruction of holes being made, on account of the elements connecting the percussion mechanism with the capsule projecting beyond the external surface thereof.

The capsule 1 can be withdrawn from the hole 3 with a winch (not shown in the drawings).

In accordance with the method embodying the invention, it is most expedient to accompany the withdrawal from the hole 3 (FIG. 3) of the capsule 1 with the soil 2 and of that soil 2 which have passed through the capsule 1 by altering the direction and frequency of the percussive action.

In the apparatus for performing the method, illustrated in FIGS. 3 and 4, the percussion mechanism 7 (FIG. 3) exerts its percussive action axially of the capsule 1 in the direction opposite to the soil intake direction, as the capsule 1 is being withdrawn from the hole 3, and exerting its action axially of the capsule 1 (FIG. 4) in the soil intake direction, as the capsule 1 is being driven into the soil 2.

In the capsule 1 of the embodiment illustrated in FIGS. 3 and 4 there is provided an element 9 partly closing the soil intake end face 4. This element 9 is adapted to completely close the end face of the capsule, open in the soil intake direction.

The advisability of incorporating this element is explained by the fact that, when the capsule is being withdrawn from the hole by the percussive action, the adhesion of the soil to the inner surface of the capsule may be insufficient for retaining the soil inside the capsule.

In the embodiment being described, this element 9 is in the form of a gate 10 (FIG. 5) pivoted on a pin 11 carried by the body of the capsule 1, for pivoting in the direction opposite to the soil intake direction, as can be seen in FIG. 4.

The abovedescribed embodiment of the apparatus, same as all the embodiments to be described hereinbelow, is intended for making a hole 3 (FIGS. 3 and 4) inside a pipe 12 that has been previously driven into the soil 2, with its open end leading.

In the embodiment of the apparatus for performing the method in accordance with the invention, illustrated in FIG. 6, the percussion mechanism 13 is attached to the inner surface 14 of the capsule 15 with a securing mechanism 16.

Figure 7:
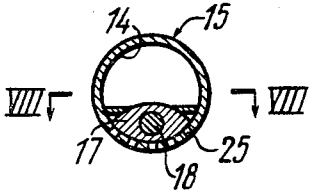
FIG. 7 is a sectional view taken on line VII—VII of FIG. 6.

This mechanism 16 for securing the percussion mechanism 13 to the inner surface 14 of the capsule 15 includes a sleeve 17 adapted to receive or accommodate therein the head portion 18 of the percussion mechanism 13, directly attached by a part of its external surface to the inner surface 14 of the capsule 15 (see FIG. 7). The axis of the sleeve 17 extends parallel with the longitudinal axis of the capsule 15. A projection of the sleeve 17 onto a plane perpendicular to the longitudinal axis of the capsule 15 is smaller than the projection of the inner contour of the capsule onto the same plane.

The mechanism 16 for securing the percussion mechanism 13 to the inner surface 14 of the capsule 15 also comprises a retaining member 19 adapted to accommodate therein the tail portion 20 of the percussion mechanism 13 with the compressed air supply hose 21, the member 19 being directly secured by a part of its external surface to the inner surface 14 of the capsule 15, coaxially with the sleeve 17, the cross-sectional dimensions of the retaining member 19 being commensurate with those of the sleeve 17.

In the embodiment being described, the retaining member 19 includes a sleeve 22 accommodating the tail portion 20 of the percussion mechanism 13 with the hose 21, secured to the inner surface 14 of the capsule 15. One end face of the sleeve 22 is slanting to act as one element of a wedge couple of which the other element is a wedge 23 engaging a thrust sleeve 24 against which the tail portion 20 of the percussion mechanism 13 abuts.

Figure 8:
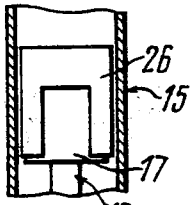
FIG. 8 is a sectional view taken on line VIII—VIII of FIG. 7.

The sleeve 17 (FIG. 7) is secured to the inner surface 14 of the capsule 15 by welding accomplished through openings 25 in the body of the capsule 15, and also with a bracket 26 (FIG. 8).

Figure 9:
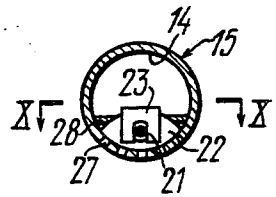
FIG. 9 is a sectional view taken on line IX—IX of FIG. 6.
Figure 10:
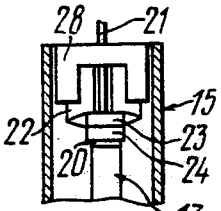
FIG. 10 is a sectional view taken on line X—X of FIG. 9.

The sleeve 22 (FIG. 9) is secured to the inner surface 14 of the capsule 15 by welding accomplished through openings 27 in the body of the capsule 15, and also with a bracket 28 (FIG. 10).

Adjacent to the end face 29 (FIG. 6) of the capsule 15, open in the soil intake direction and remote from the open end face 30 adjacent to which the percussion mechanism 13 is mounted, there is provided a pivot pin 31 supporting a gate 32 pivotable in the direction opposite to the soil intake direction (i.e. serving as the element 9 partly closing the end face 29).

Figure 11:
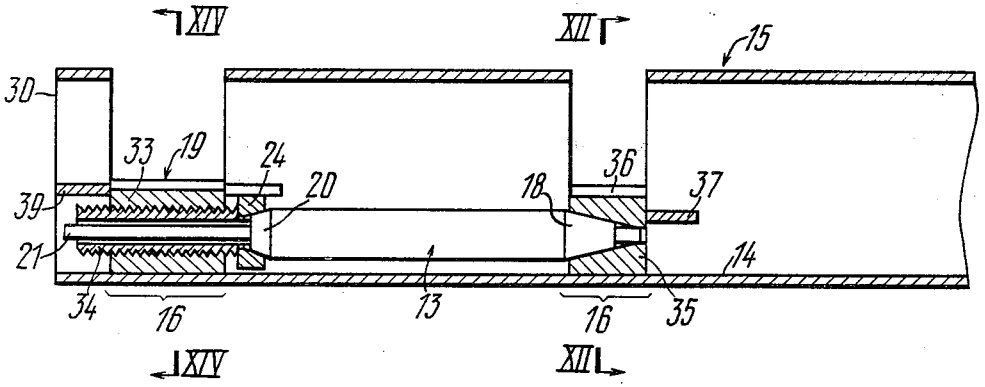
FIG. 11 is a longitudinal sectional view on an enlarged scale of another version of the apparatus illustrated in FIG. 6.

In another version of the apparatus embodying the invention, illustrated in FIG. 11, the retaining member 19 (FIG. 11) of the securing mechanism 16 includes a sleeve 33 accommodating the tail portion 20 of the percussion mechanism 13 with the hose 21, secured to the inner surface 14 of the capsule 15. The inner surface of the sleeve 33 is threaded to act as one element of a screw-and-nut couple of which the other element is the externally threaded sleeve 34 of which the end face engages the end face of the thrust sleeve 24.

Figure 12:
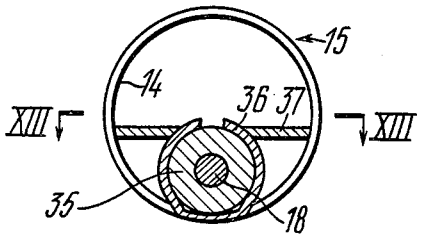
FIG. 12 is a sectional view taken on line XII—XII of FIG. 11.
Figure 13:
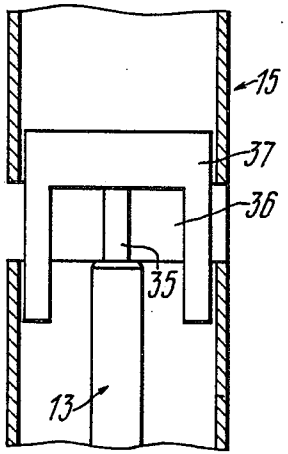
FIG. 13 is a sectional view taken on line XIII—XIII of FIG. 12.

In the securing mechanism 16, the sleeve 35 (FIG. 11 and FIG. 12) adapted to accommodate the head portion 18 of the percussion mechanism 13 is secured to the inner surface 14 of the capsule 15 with tabs 36 cut from the capsule 15 to encompass the sleeve 35, and also with a bracket 37 (FIGS. 12 and 13).

Figure 14:
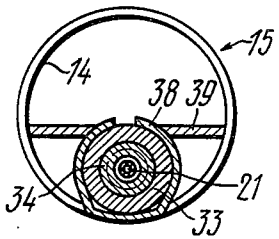
FIG. 14 is a sectional view taken on line XIV—XIV of FIG. 11.

The sleeve 33 (FIG. 14) is secured to the inner surface 14 of the capsule 15 with tabs 38 cut from the capsule 15 to encompass the sleeve 33, and also with a bracket 39.

Figure 15:
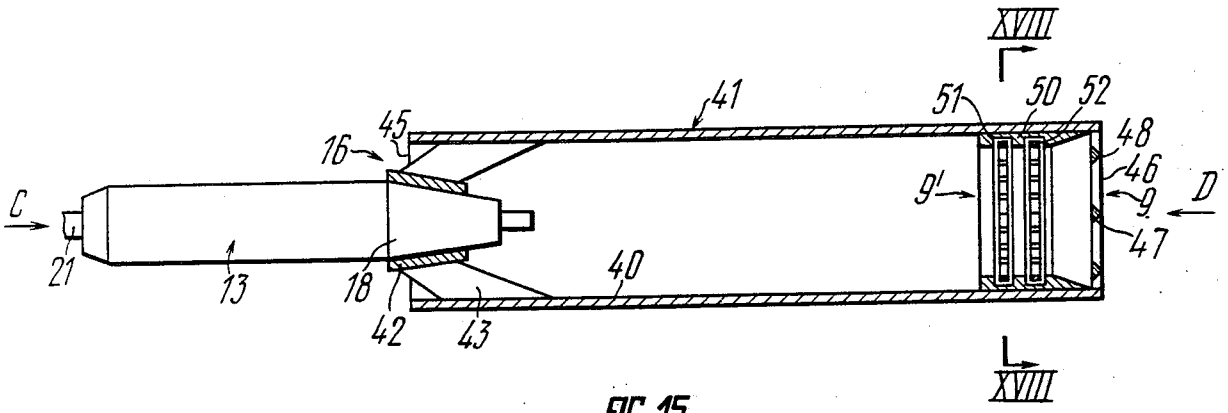
FIG. 15 is a longitudinal sectional view of still another version of an apparatus for performing a method in accordance with the invention.

A version of the apparatus for performing a method in accordance with the present invention, illustrated in FIG. 15, is particularly adapted for making holes in compact and binder soils.

Figure 16:
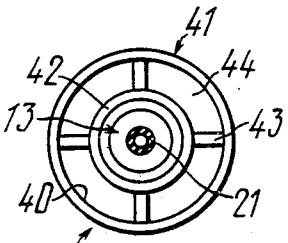
FIG. 16 is a view taken along arrow line C in FIG. 15.

In this version the mechanism 16 securing the percussion mechanism 13 to the inner surface 40 of the capsule 41 includes a sleeve 42 adapted to accommodate the head portion 18 of the percussion mechanism 13. The sleeve 42 is arranged coaxially with the capsule 41 and is secured to the latter's inner surface 40 with ribs 43 defining therebetween openings or ports 44 (FIG. 16) rendering partly open the end face 45 (FIG. 15) of the capsule 40, opposite to the end face 46 open in the soil intake direction.

This version of the apparatus embodying the invention has two elements 9 and 9' partly closing the end face 46 of the capsule 41.

Figure 17:
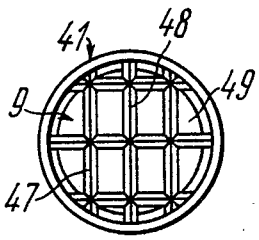
FIG. 17 is a view taken along arrow line D in FIG. 15.

The element 9 includes a set of blades 47 (FIG. 17) having their sharpened edges 48 (FIG. 15) facing in the soil intake direction. The blades 47 (FIG. 17) are aranged to define therebetween openings or ports 49.

Figure 18:
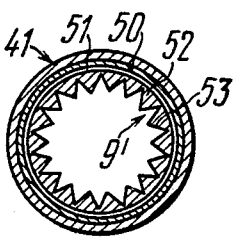
FIG. 18 is a sectional view taken on line XVIII—XVIII of FIG. 15.

The element 9' includes a sleeve 50 (FIG. 15) of which the inner surface has made therein two annular grooves 51 receiving axially displaceable rings 52. The rings 52 each have a serrated inner surface 53, as shown in FIG. 18.

Figure 19:
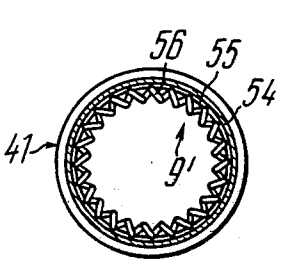
FIG. 19 is a cross-sectional view of a version of the element of the apparatus embodying the invention, partly closing the end face open in the soil intake direction.

The element 9' (FIG. 19) partly closing the end face of the capsule 41, open in the soil intake direction, can alternatively include a sleeve 54 of which the inner surface has made therein a series of annular grooves receiving springs 56 each coiled into a ring, the springs 56 being accommodated in the respective grooves 55 for axial displacement.

In a version of the apparatus embodying the invention, particularly adapted for making holes in loose soils, the removal of the soil from the capsule 57 (FIG. 20) is facilitated by the latter being shaped, adjacent to its open end face 58 opposite to the end face 59 open in the soil intake direction, as a trough 60 of which the inner surface 61 has the percussion mechanism 13 secured thereto.

In this embodiment of the apparatus there are two elements 9 and 9' partly closing the end face 59. The elements 9 and 9' include, respectively, gates 62 and 63 mounted on pins 64 and 65 for pivoting in the direction opposite to the soil intake direction, with the gate 62 partly closing one half of the end face 59 at the side of the percussion mechanism 13, and the gate 63 partly closing the remaining half of the end face 59. The pivoting of the gate 63 in the soil intake direction is limited by an abutment 66.

Figure 20:
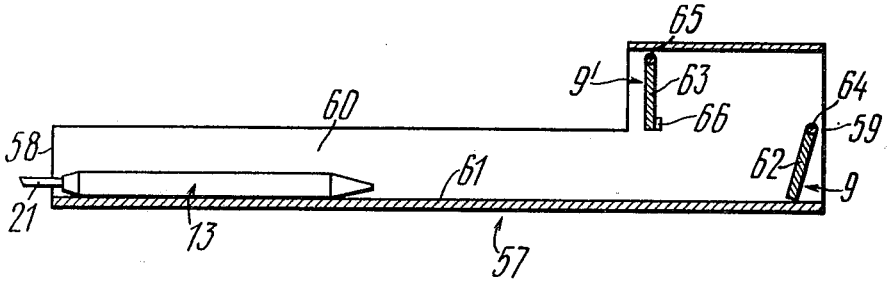
FIG. 20 is a longitudinal sectional view of yet another version of the apparatus embodying the invention.
Figure 21:
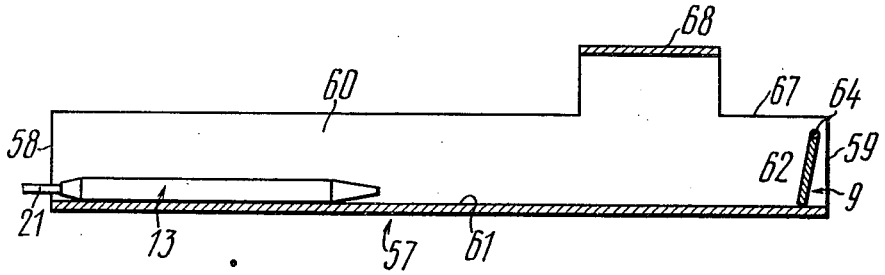
FIG. 21 is a longitudinal sectional view of a modification of the apparatus illustrated in FIG. 20.

The version of the apparatus illustrated in FIG. 21 is similar to that shown in FIG. 20.

The difference is in that the capsule 57 adjacent to the end face 59 is likewise shaped as a trough 67 arranged at the same side as the trough 60. Interconnecting the angularly aligned troughs 60 and 67 is a portion of the capsule 57 shaped as a cylinder 68 and intended to shape the hole being made.

Figure 22:
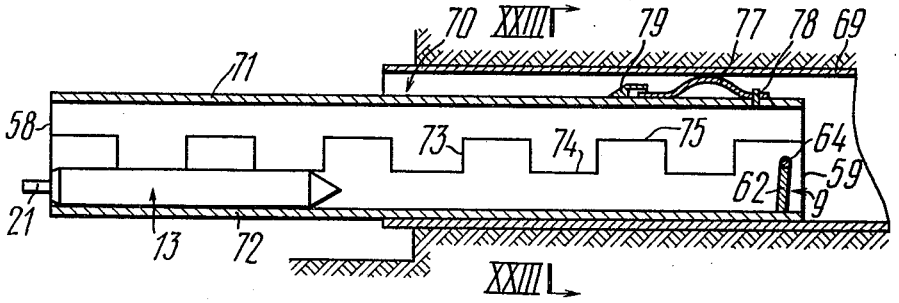
FIG. 22 is a longitudinal sectional view of one more version of the apparatus for performing a method in accordance with the invention.

The version of the apparatus for performing a method in accordance with the invention, illustrated in FIG. 22, is particularly adapted for cleaning a pipe 69 from soil.

In this version, the body or housing of the capsule 70 is made up of two longitudinally extending parts 71 and 72 conjugated by their sides longitudinally of the capsule 70 along a broken line 73. The contour or outline of the broken line 73 is defined by alternating projections 74 and recesses 75 provided on these parts 71 and 72 so that the recesses 75 of one part should complement the projections 74 of the other part (in the drawing, the projection 74 and recesses 75 are those of the art 71).

Figure 23:
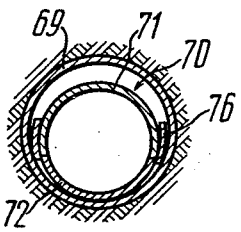
FIG. 23 is a sectional view taken on line XXIII—XXIII of FIG. 22.

One part 72 (FIG. 23) of the capsule 70 carry plates 76 precluding detachment of the parts 71 and 72 of the capsule 70.

One part 71 (FIG. 22) of the capsule 70 carries a resilient member 77 adapted to engage the pipe 69. One of the ends of the resilient member has an opening receiving a stud 78 attached to the part 71 of the capsule 70 adjacent to the soil intake end. The other end of the resilient member 77 is slidably received in a guide stirrup 79.

To be capable of cleaning pipes of various diameters from soil, this version of the apparatus, illustrated in FIG. 20, can also be provided with a resilient member 80 (FIG. 24) of which one end is further provided with an element 81 for adjusting the effort of urging the resilient member 80 against the pipe 82.

Figure 25:
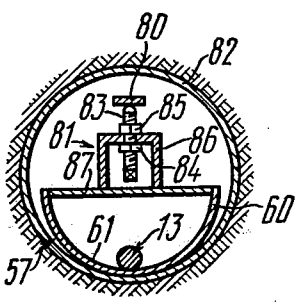
FIG. 25 is a sectional view taken on line XXV—XXV of FIG. 24.

The element 81 (FIG. 25) includes a bolt 83 with a nut 84 and locknut 85, supported by a bracket 86 mounted on a bridging piece 87 spanning the trough-shaped portion 60 of the capsule 57.

Figure 26:
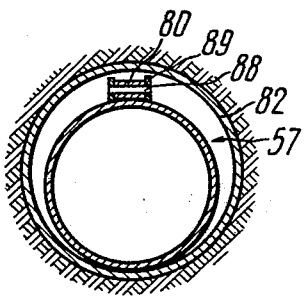
FIG. 26 is a sectional view taken on line XXVI—XXVI of FIG. 24.

The other end of the resilient member 80 (FIG. 24) is rotatably mounted on a pin 88 (FIG. 26) supported by ribs 89 secured to the capsule 57 (FIG. 24) adjacent to the soil intake end.

The operating principle of the disclosed apparatus for making holes in the soil, capable of performing the method in accordance with the invention, is as follows.

The capule 1 (FIG. 1) is driven into the soil 2 by percussive action exerted by the percussion mechanism 7 operated by compressed air supplied thereto via the hose 8.

The percussive action is directed longitudinally of the capsule 1 in the soil intake direction. When the capsule 1 becomes filled with the soil 2 through its open leading end 4, the driving of the capsule 1 into the soil 2 is continued, while passing the soil 2 therethrough, the soil entering the hole 3 through the at least partly open end face 5 (FIG. 2) of the capsule 1.

Then the capsule 1 (FIG. 1) with the soil filling it is withdrawn from the hole 3 with a winch (not shown), the soil is removed therefrom, and the capsule 1 is once again run into the hole 3. The percussive action of the mechanism 7 advances the capsule 1 through the hole 3, so that the capsule 1 abuts against its bottom and pentrates it.

Then the abovedescribed cycle is repeated.

A characteristic feature of the operating principle of the disclosed apparatus illustrated in FIG. 3 is that the withdrawal of the capsule 1 with the soil 2 and of that part of the soil 2 which has passed through the capsule 1 is effected simultaneously with altering the direction and frequency of the percussive action exerted upon the capsule 1 by the percussion mechanism 7.

As the capsule 1 is withdrawn from the pipe 12 being cleaned from the soil 2 by the percussive action of the mechanism 7, directed in opposition to the soil intake direction, the adhesion of the soil 2 to the inner surface 6 of the capsule 1 is insufficient for retaining the soil 2 thereinside, and it is for this reason that the capsule 1 is provided with the element 9 capable of partly closing the leading end face 4 of the capsule 1, in the form of the gate 10 pivotably mounted on the pin 11, as shown in FIG. 5.

The performance of the element 9 is as follows.

As the capsule 1 (FIG. 4) penetrates the soil 2 under the percussive action of the mechanism 7, the soil 2 entering the capsule 1 turns the gate in the direction opposite to that of the soil penetration. The soil 2 thus fills the capsule 1, and, as the latter moves on, enters the hole 3 through the at least partly open opposite end face 5 of the capsule 1.

As the capsule 1 (FIG. 3) is being withdrawn from the hole 3, i.e. when the direction of the percussive action exerted upon the capsule 1 is reversed, and the frequency of this action is altered, the soil 2 filling the capsule 1 rotates the gate 1 in the closing direction, whereby the end face 4 of the capsule 1 becomes closed, and the motion of the soil 2 off the capsule 1 is additionally opposed.

The operating principle of the versions of the disclosed apparatus described hereinabove in connection with the drawings, FIGS. 6 to 22, is basically similar to the operation of the apparatus illustrated in FIGS. 3 and 4. However, each version has some specific features of its operation, which will be described hereinbelow.

Thus, in the apparatus illustrated in FIG. 6, the stability of the capsule 15 in a hole is enhanced by the percussion mechanism 13 being secured to the inner surface 14 of the capsule 15 so that the gravity center of the percussion mechanism 13 is offset toward this inner surface 14 to one side, whereas the pivoing axis 31 of the gate 32 is offset toward this inner surface 14 to the diametrically opposite side.

The percussion mechanism 13 is secured to the capsule 1 by the securing mechanism 16 including the axially aligned sleeve 17 and retaining member 19, their common axis being parallel with that of the capsule 15.

This manner of attaching the percussion mechanism 13 to the capsule 15 enables removal of the percussion mechanism 13 for other uses. This can be done by disengaging the wedge couple defined by the sleeve 22 and the wedge 23 and withdrawing the percussion mechanism from the sleeve 17.

In the modification of the apparatus of FIG. 6, illustrated in FIG. 11, the retaining member 19 includes a threaded couple defined by the sleeves 33 and 34. To remove the percussion mechanism 13, the sleeve 34 is rotated relative to the sleeve 33 for their relative axial displacement, to release the percussion mechanism 13 so that it can be withdrawn from the sleeve 35.

To increase the rate of hole-drilling in binder and compact soils, in the version of the apparatus illustrated in FIG. 15, the blades 47 and the rings 52C serrated surface 53 break up the soil structure, which facilitates the penetration of the capsule 41 into the soil, same as the penetration of the soil into the capsule 41.

The coiled spring (FIG. 19) is as capable of breaking up the soil as rings 52 (FIG. 18) with the serrated surface 53.

The version of the disclosed apparatus, illustrated in FIG. 20, is specifically adapted for making holes in loose soils. The incorporation of the two spaced gates 62 and 63 improves the conditions of avoiding spilling the taken up soil from the capsule 57 as the latter is withdrawn from the hole.

The provision of the trough-shaped portion 60, on the other hand, facilitates removal of soil from the capsule 57 following its withdrawal from the hole.

The operation of the apparatus illustrated in FIG. 21 is identical to that of the apparatus illustrated in FIG. 20.

To facilitate cleaning the pipe 69 from soil, in the version of the apparatus illustrated in FIG. 22, the capsule 70 is made up of the two elongated parts 71 and 72 conjugated along the broken line 73. The plates 76 (FIG. 23) and the resilient member 77 (FIG. 22) prevent disengagement of these parts 71 and 72 while the capsule 70 is being filled up with the soil. Following the withdrawal of the capsule 70 from the pipe 69, the parts 71 and 72 are disengaged, so that the soil is easily removed from the entire capsule.

Figure 24:
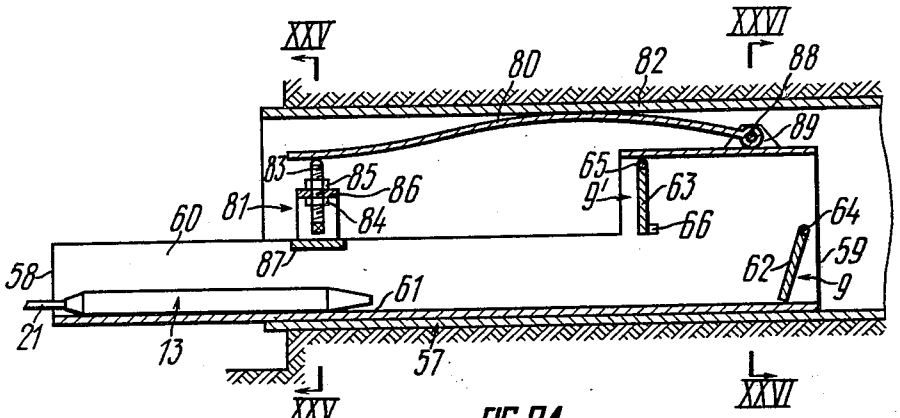
FIG. 24 is a longitudinal sectional view of still another modification of the apparatus illustrated in FIG. 20.

In the modification of the apparatus illustrated in FIG. 24, the effort of urging the resilient member 80 against the pipe 82 is adjustable with the adjustment element 81, which is essential when the apparatus is used for cleaning pipes of various diameters.

The disclosed apparatus for making holes in the soil, performing the method in accordance with the invention, is practically capable of making in the soil various holes of a diameter as great as 800 mm, at the rate of 1 to 4 meters per hour; it enables to introduce a high degree of mechanisation into the process of cleaning pipes of any length, driven into the soil with their open end leading by either the static driving technique or the dynamic one.

In the above description of the embodiments of the invention, specific terms and expressions are used for clarity sake. The invention, however, is in no way limited by these terms and expressions, and it should be understood that each term or expression is meant to include other equivalent elements and means operable in a similar manner for like purposes.

It should be also understood that although the present invention has been described hereinabove in connection with its preferred embodiments, various modifications and changes may take place without departing from the spirit and scope of the invention, which those competent in the art will readily comprehend.

Such modifications and changes are considered falling within the scope of the invention and of the claims to follow.

We claim:

1. A method of making holes in soil, including the steps of:

driving a capsule into the soil by percussive action;

filling the capsule with the soil;

continuing driving said capsule into the soil by the percussive action, following its filling with the soil, while passing the soil therethrough;

withdrawing said capsule from the hole thus made, simultaneously with removing from the hole the soil that has passed through said capsule, and removing the soil from said capsule itself.

2. A method of claim 1, wherein the withdrawing of said capsule with the soil from the hole and the removing of the soil that has passed therethrough are accompanied by altering the frequency and direction of the percussive action.

3. An apparatus for making holes in soil, comprising: a capsule receiving the soil therein, and having a longitudinal axis, a first end face open in the soil intake direction, and a second end face opposite to said first end face and being at least partly open; and a percussion mechanism having a head portion and a tail portion and being attached to an inner surface of said capsule.

4. An apparatus of claim 3, wherein said percussion mechanism is secured to said inner surface of said capsule adjacent to said second end face.

5. An apparatus of claim 4, wherein said capsule incorporates at least one element at least partly closing said first end face.

6. An apparatus of claim 5, wherein said element at least partly closing said first end face includes at least one gate mounted for pivoting in the direction opposite to the soil intake direction.

7. An apparatus of claim 6, wherein said capsule is shaped as a trough adjacent to said second end face.

8. An apparatus of claim 7, wherein said capsule is shaped as a trough adjacent to said first end face, arranged at the same side of said capsule as said trough adjoining said second end face, said two troughs being interconnected by a portion of said capsule shaped as a cylinder.

9. An apparatus of claim 6, wherein said a housing of said capsule includes two elongated parts conjugated by their respective sides along said longitudinal axis of said capsule, following a broken line, the contour of said broken line being defined by alternating recesses and projections made in said elongated parts so that said recesses of one said part complement said projections of the other said part.

10. An apparatus of claim 9, wherein said capsule is used to make a hole in soil in a pipe; and wherein one of said elongated parts of said housing of said capsule is provided with a resilient member engaging said pipe and having a first end and a second end, said first end being secured to said elongated part.

11. An apparatus of claim 10, wherein said second end of said resilient member is provided with means for adjusting the effort of urging said resilient member against said pipe.

12. An apparatus of claim 5, wherein said first element at least partly closing said end face includes a set of blades having their respective sharpened edges facing in the soil intake direction and arranged to define openings therebetween.

13. An apparatus of claim 12, wherein said capsule is shaped as a trough adjacent to said second end face.

14. An apparatus of claim 13, wherein said capsule is shaped as a trough adjacent to said first end face, arranged at the same side of said capsule as said trough adjoining said second end face, said two troughs being interconnected by a portion of said capsule shaped as a cylinder.

15. An apparatus of claim 12, wherein a housing of said capsule includes two elongated parts conjugated by their respective sides along said longitudinal axis of said capsule, following a broken line, the contour of said broken line being defined by alternating recesses and projections made in said elongated parts so that said recesses of one said part complement said projections of the other said part.

16. An apparatus of claim 15, wherein said capsule is used to make a hole in soil in a pipe; and wherein one of said elongated parts of said housing of said capsule is provided with a resilient member engaging said pipe and having a first end and a second end, said first end being secured to said elongated part.

17. An apparatus of claim 16, wherein said second end of said resilient member is provided with means for adjusting the effort of urging said resilient member against said pipe.

18. An apparatus of claim 5, wherein said first element at least partly closing said end face includes a sleeve having at least one annular groove made in the inner surface thereof, receiving for limited axial displacement either a ring with the serrated internal surface or a spring.

19. An apparatus of claim 18, wherein said capsule is shaped as a trough adjacent to said second end face.

20. An apparatus of claim 19, wherein said capsule is shaped as a trough adjacent to said first end face, arranged at the same side of said capsule as said trough adjoining said second end face, said two troughs being interconnected by a portion of said capsule shaped as a cylinder.

21. An apparatus of claim 18, wherein a housing of said capsule includes two elongated parts conjugated by their respective sides along said longitudinal axis of said capsule, following a broken line, the contour of said broken line being defined by alternating recesses and projections made in said elongated parts so that said recesses of one part complement said projections of the other said part.

22. An apparatus of claim 21, wherein said capsule is used to make a hole in soil in a pipe; and wherein one of said elongated parts of said housing is provided with a resilient member engaging said pipe and having a first end and a second end, said first end being secured to said elongated part.

23. An apparatus of claim 22, wherein said second end of said resilient member is provided with means for adjusting the effort of urging said resilient member against said pipe.

24. An apparatus of claim 4, wherein said percussion mechanism is secured to said inner surface of said capsule by means of a securing mechanism.

25. An apparatus of claim 24, wherein said securing mechanism securing said percussion mechanism to said inner surface of said capsule comprises:

a sleeve therein said head portion of said percussion mechanism, directly attached by a part of the external surface thereof to said inner surface of said capsule, and retaining means therein said tail portion of said percussion mechanism, directly attached by a part of the external surface thereof to said inner surface of said capsule, coaxially with said sleeve, and having cross-sectional dimensions commensurate with the cross-sectional dimensions of said sleeve;

the axis of said sleeve being parallel with said longitudinal axis of said capsule, and the projection of said sleeve onto a plane perpendicular to said longitudinal axis of said capsule being smaller than the projection of the internal contour of said capsule onto the same plane.

26. An apparatus of claim 25, wherein said retaining means includes a sleeve accommodating therein said tail portion of said percussion mechanism, said sleeve being attached to said inner surface of said capsule and serving as one element of either a screw-and-nut couple or a wedge couple.

27. An apparatus of claim 9, wherein said securing mechanism securing said percussion mechanism to said inner surface of said capsule includes a sleeve receiving therein said head portion of said percussion mechanism, arranged coaxially with said capsule and attached to said inner surface thereof with ribs.

28. An apparatus of claim 3, wherein said capsule incorporates at least one element at least partly closing said first end face.

29. An apparatus of claim 3, wherein said capsule is shaped as a trough adjacent to said second end face.

30. An apparatus of claim 29, wherein said capsule is shaped as a trough adjacent to said first end face, arranged at the same side of said capsule as said trough adjoining said second end face, said two troughs being interconnected by a portion of said capsule shaped as a cylinder.

31. An apparatus of claim 3, wherein a housing of said capsule includes two elongated parts conjugated by their respective sides along said longitudinal axis of said capsule, following a broken line, the contour of said broken line being defined by alternating recesses and projections made in said elongated parts so that said recesses of one said part complement said projections of the other said part.

32. An apparatus of claim 31, wherein said capsule is used to make a hole in soil in a pipe; and wherein one of said elongated parts of said housing of said capsule is provided with a resilient member engaging said pipe and having one end secured to said elongated part.

* * * * *